US009865969B2

(12) United States Patent
Ebisawa

(10) Patent No.: US 9,865,969 B2
(45) Date of Patent: Jan. 9, 2018

(54) CONNECTOR ASSEMBLY WHICH IS CONFIGURED TO BE MOUNTED ON A STRUCTURAL MEMBER VIA A FIXING MEMBER

(71) Applicant: Molex, LLC, Lisle, IL (US)

(72) Inventor: Jumpei Ebisawa, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/470,280

(22) Filed: Mar. 27, 2017

(65) Prior Publication Data

US 2017/0331224 A1 Nov. 16, 2017

(30) Foreign Application Priority Data

May 12, 2016 (JP) ..... 2016-095982

(51) Int. Cl.
*H01R 13/627* (2006.01)
*H01R 13/639* (2006.01)

(52) U.S. Cl.
CPC ..... *H01R 13/639* (2013.01); *H01R 13/6272* (2013.01)

(58) Field of Classification Search
CPC . H01R 13/6272; H01R 13/6275; H01R 24/62
USPC ..... 439/354, 533, 575, 527
See application file for complete search history.

(56) References Cited

U.S. PATENT DOCUMENTS 6,203,364 B1 * 3/2001 Chupak ..... H01R 13/60 439/527
7,534,134 B2 * 5/2009 Qiu ..... H01R 13/73 439/527
7,753,701 B2 * 7/2010 Tsuji ..... H01R 13/4538 439/148

FOREIGN PATENT DOCUMENTS

JP 01-130280 U 9/1989

* cited by examiner

*Primary Examiner* — Phuong Dinh
(74) *Attorney, Agent, or Firm* — James A. O'Malley

(57) ABSTRACT

A connector assembly having first and second connectors. The first connector includes a first housing which is configured to receive an installed fixing member. The second connector includes a second housing which is mated with the first connector. The first housing includes a fixing member installation portion having a deformable flexible locking member for locking the fixing member. The second housing includes a stopping member for preventing deformation of the flexible locking member when mating of the first connector and the second connector has been completed.

7 Claims, 11 Drawing Sheets

CONNECTOR ASSEMBLY WHICH IS CONFIGURED TO BE MOUNTED ON A STRUCTURAL MEMBER VIA A FIXING MEMBER

RELATED APPLICATIONS

This application claims priority to Japanese Application No. 2016-095982, filed May 12, 2016, which is incorporated herein by reference in its entirety.

TECHNICAL FIELD

The present disclosure relates to a connector.

BACKGROUND ART

A connector for electrical wires used in automobiles is mounted on a structural member such as the body of the automobile via a mounting stay consisting of a metal plate (see, for example, Patent Document 1).

FIG. 13 is a perspective view of a connector of the prior art.

In this drawing, 811 is the housing of a male connector made of an insulating resin material. This housing 811 accommodates a plurality of terminals (not shown). A locking protrusion 815 is integrally formed on the upper surface of the housing 811.

Here, 911 is the housing of a female connector made of an insulating resin material. This housing 911 has an accommodating chamber 918 for receiving the inserted housing 811 of the male connector. A stay insertion portion 912 is integrally formed in the upper surface of the housing 911. The stay insertion portion 912 includes insertion grooves 912*a* for the stay 891 on both sides.

Here, the stay 891 is a plate made of a metal such as steel with a locking hole 895 formed near the leading end. The base end (not shown) of the stay 891 is fixed to a structural member such as the body of the automobile.

A cantilevered flexible operating piece 913 is arranged in the stay insertion portion 912. A protruding locking claw 916 to be locked in the locking hole 895 is formed on the upper surface of the flexible operating piece 913 near the free end. Also, a pressure-applying protrusion 915 to engage the locking protrusion 815 is formed on the lower surface of the flexible operating piece 913 near the free end.

When the housing 811 of the male connector is inserted into the accommodating chamber 918 and mated with the housing 911 of the female connector, the locking protrusion 815 engages the pressure-applying protrusion 915. When the locking protrusion 815 overcomes the pressure-applying protrusion 915, the free end of the flexible operating piece 913 is elastically displaced upwards.

Next, when the stay 891 has been inserted into the insertion grooves 912*a* on both sides and the stay 891 has been pushed into the stay insertion portion 912, the lower surface of the stay 891 comes into contact with the upper surface of the flexible operating piece 913, and the locking claw 916 is locked in the locking hole 895. Because the free end of the flexible operating piece 913 cannot be displaced upwards, the locking protrusion 815 and the pressure-applying protrusion 915 are kept from becoming disengaged, and the housing 811 of the male connector and the housing 911 of the female connector are kept from becoming disengaged. Also, because the pressure-applying protrusion 915 comes into contact with the locking protrusion 815, the free end of the flexible operating piece 913 cannot be displaced downwards, the locking claw 916 and the engaging hole 895 are kept from becoming disengaged, and the stay 891 is kept from becoming disengaged from the stay insertion portion 912.

Patent Document 1: Laid-Open Utility Model Publication No. 01-130280

SUMMARY

However, in the connector of the prior art, when the stay 891 is inserted into the stay insertion portion 912, the pressure-applying protrusion 915 has already come into contact with the locking protrusion 815, and the free end of the flexible operating piece 913 cannot be displaced downwards. Therefore, the leading end of the stay 891 made of metal shaves the locking claw 916 of the flexible operating piece 913 made of a resin material as it is inserted into the stay insertion portion 912. As a result, a significant amount of force, that is, installation force, is required to insert the stay 891 into the stay insertion portion 912 and mount the connector. Because the locking claw 916 is shaved every time the stay 891 is mounted in the connector, the service life of the locking claw 916 is reduced and repeated operations in which the stay 891 is mounted in the connector becomes impossible.

It is an object of the present disclosure to solve this problem associated with the prior art by providing a connector which requires the use of very little installation force for the fixing member, which reliably keeps the fixing member from becoming detached, which is highly reliable, which has low manufacturing costs, and which is highly durable.

Specifically, the present disclosure is a connector comprising a first connector including a first housing which is capable of receiving an installed fixing member and a second connector including a second housing which is mated with the first connector, the first housing including a fixing member installation portion having a deformable flexible locking member for locking the fixing member, and the second housing including a stopping member for preventing deformation of the flexible locking member when mating of the first connector and the second connector has been completed.

In another connector, the fixing member includes a locking recessed portion, and the flexible locking member includes a locking protruding portion for locking the locking recessed portion when installation of the fixing member on the first connector has been completed.

In another connector, the fixing member installation portion is arranged on a side surface of the first housing, the first housing also includes a locking protruding portion arranged on a side surface other than the one on which the fixing member installation portion has been arranged, the stopping member is arranged on a side surface of the second housing, and the second housing also includes a locking recessed portion arranged on a side surface other than the one on which the stopping member has been arranged, the locking recessed portion engaging the locking protruding portion when mating of the first connector and the second connector has been completed.

In another connector, the fixing member is installed in the fixing member installation portion by moving the fixing member relative to the first connector in the mating direction of the first connector with the second connector.

In another connector, the flexible locking member is a cantilevered plate extending in the mating direction of the first connector with the second connector or in the opposite direction thereof and displaceable towards the inside of the first housing, and at least a portion of the second housing enters the first housing and the stopping member is prevented from being displaced towards the inside of the first housing by the flexible engaging member when mating of the first connector and the second connector has been completed.

In another connector, the fixing member has a mounting plate portion formed on the leading end, the flat mounting plate portion being installed on the fixing member installation portion, and a base end fixed to a structural member.

In another connector, the fixing member has a flat mounting plate portion installed on the fixing member installation portion, and a fixed portion connected to a surface of the mounting plate portion and fixed to a structural member.

The present disclosure is able to provide a connector which requires the use of very little installation force for the fixing member, which reliably keeps the fixing member from becoming detached, which is highly reliable, which has low manufacturing costs, and which is highly durable.

BRIEF DESCRIPTION OF THE DRAWINGS

FIGS. 1A and 1B are a pair of perspective views of the first connector in a first embodiment, in which FIG. 1A is a view from above and FIG. 1B is a view from below.

FIGS. 2A and 2B are a pair of perspective views of the second connector in the first embodiment, in which FIG. 2A is a view from above and FIG. 2B is a view from below.

FIGS. 4A and 4B are a pair of perspective views showing the operations performed to install the fixing member on the first connector in the first embodiment, in which FIGS. 4A and 4B are views showing the fixing member being mounted on the first connector.

DETAILED DESCRIPTION OF THE PREFERRED EMBODIMENTS

The following is a detailed explanation of embodiments of the present invention with reference to the drawings.

Figure 1A:
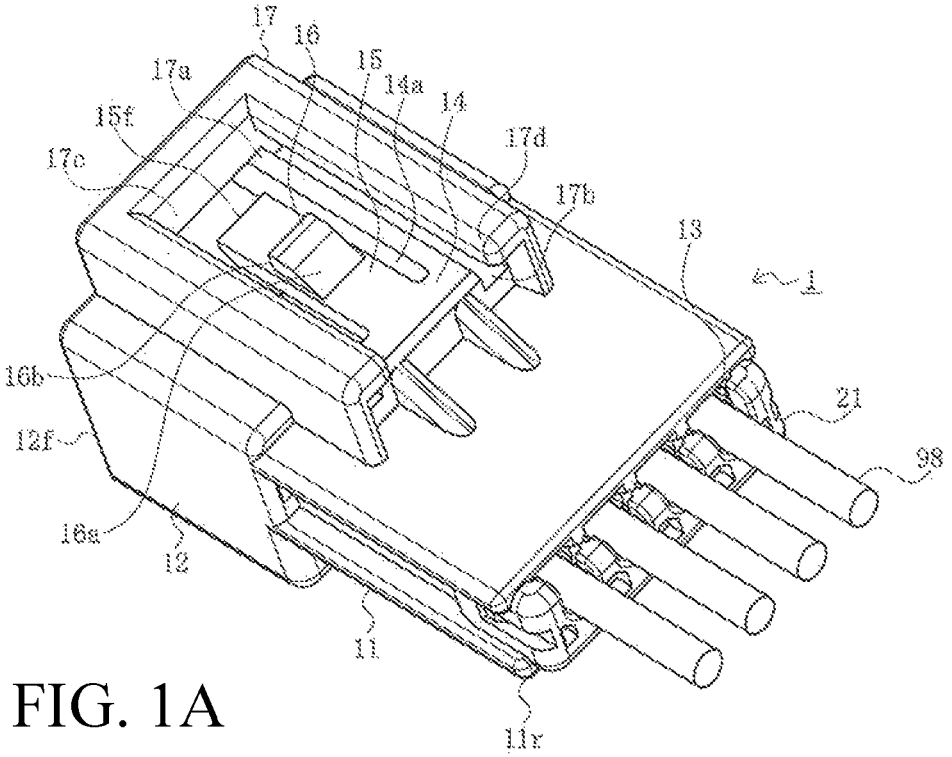
Figure 1B:
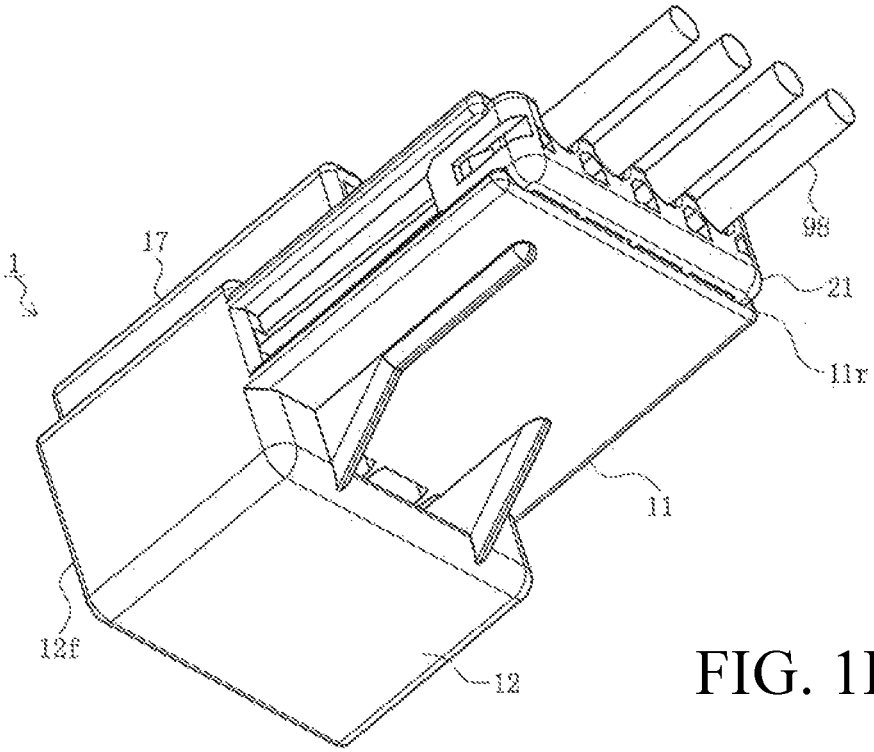
Figure 2A:
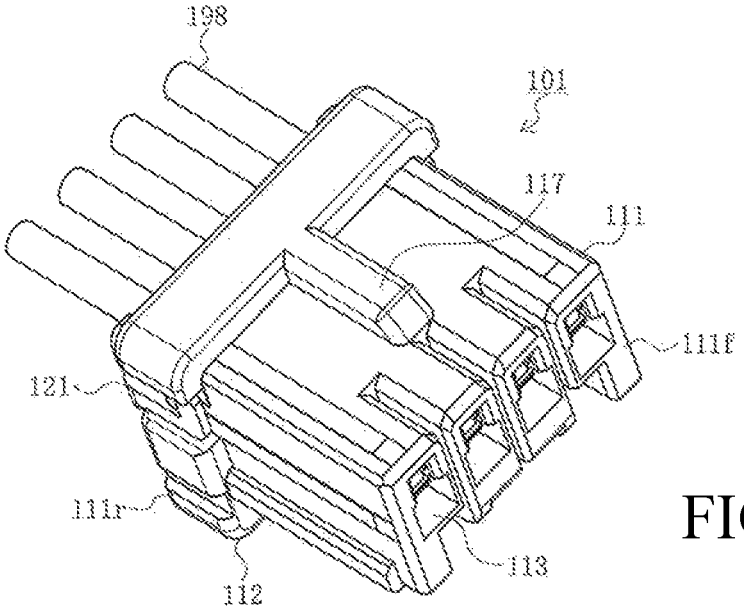
Figure 2B:
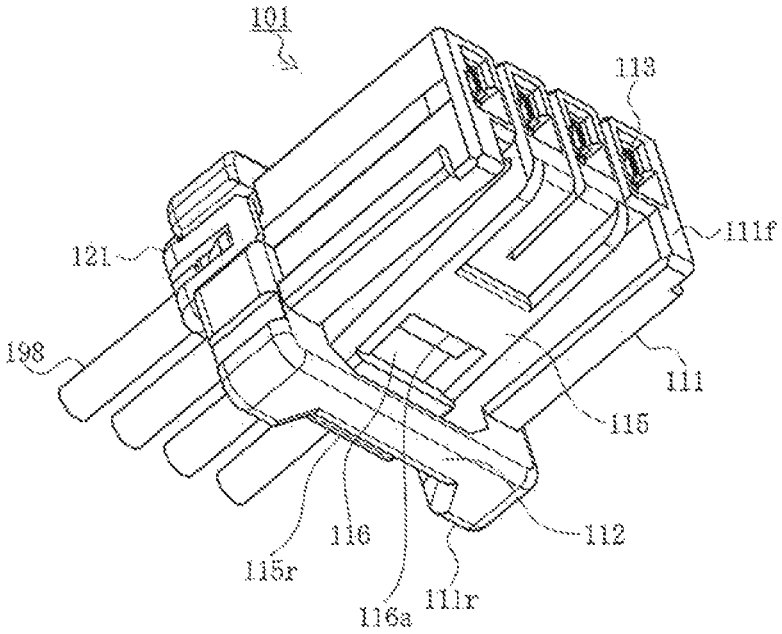
Figure 3:
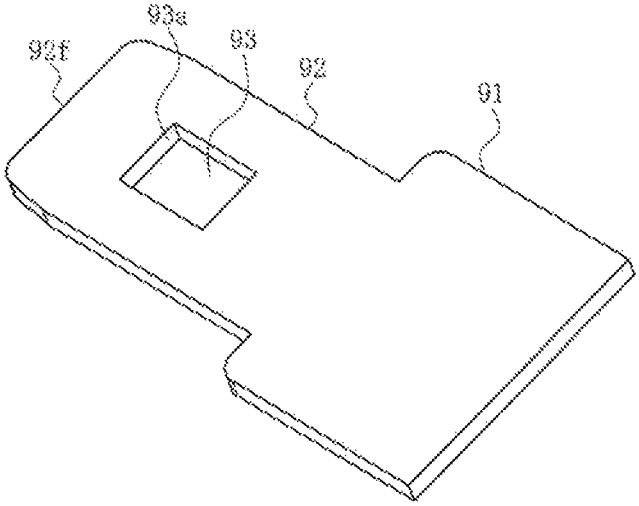
FIG. 3 is a perspective view of the fixing member in the first embodiment.

FIGS. 1A and 1B are a pair of perspective views of the first connector in a first embodiment, FIGS. 2A and 2B are a pair of perspective views of the second connector in the first embodiment, and FIG. 3 is a perspective view of the fixing member in the first embodiment.

In the drawings, 1 is the first connector in the present embodiment which is connected to the end of a cable containing a plurality of electrical wires 98. Here, 2 is the second connector in the preset embodiment which is connected to the end of a cable containing a plurality of electrical wire 198. Also, 91 is a fixing member in the present embodiment which is a band-like plate made of a metal such as steel whose base end is fixed to a structural member. The mounting plate portion 92 formed on the leading end is mounted in the first connector 1 to securely mount the connector on the structural member. In the present embodiment, the fixing member 91 is usually a slender plate called a stay. However, for the sake of convenience, the base end is not depicted in the drawings. Only the mounting plate portion 92 and its environs are shown.

The first connector 1 and the second connector 101 provide a connector assembly that may be used in production equipment, household appliances, air conditioning units, and hot water units, but here, for the sake of convenience, the connector assembly is used to connect cables in a vehicle such as an automobile, and are mounted on a structural member such as the body of a vehicle via a fixing member 91.

In the present embodiment, the expressions indicating direction, such as upper, lower, left, right, front and rear, which are used to explain the configuration and operation of the first connector 1, the second connector 101, and the fixing member 91 are relative and not absolute. They depend on the orientation of the first connector 1, the second connector 101, the fixing member 91, and their constituent components shown in the drawings. When the orientation of the first connector 1, the second connector 101, the fixing member 91, or their constituent components changes, the interpretation changes in response to the change in orientation.

The first connector 1 is integrally molded from an insulating material such as a synthetic resin, and consists of a first housing 11 mated with the second connector 101 and first terminals (not shown) made of metal which are mounted in the first housing 11.

The first housing 11 is a substantially parallelepiped box-like member extending in the arrangement direction of the electrical wires 98, that is, in the transverse direction of the first connector 1, and in the mating direction with the second connector 101, that is in the longitudinal direction of the first connector 1. The first housing 11 includes a covering portion 12 covering a portion of the first housing 11 near the front end, and a fixing member installation portion 17 formed on the upper surface of the covering portion 12.

Also, the first housing 11 includes a plurality of terminal accommodating recessed portions 13 open on the rear end 11*r* and extending in the longitudinal direction of the first connector 1. Each first terminal (not shown) connected and fixed to the front end of an electrical wire 98 is housed and held inside a terminal accommodating recessed portion 13. Each electrical wire 98 protrudes from an opening in a terminal accommodating recessed portion 13 to the rear of the first housing 11. In the example shown in the drawings, there are four first terminals and electrical wires 98 arranged side by side in a single row in the transverse direction of the first connector 1 at a predetermined pitch. However, the number of first terminals, the number of electrical wires 98, the pitch, and the number of rows can be changed if desired. A first retainer 21 is mounted on the rear end 11*r* of the first housing 11 to keep the first terminals and the electrical wires 98 from becoming detached from the terminal accommodating recessed portions 13.

The fixing member installation portion 17 is a substantially parallelepiped box-like member protruding upwards from the upper surface of the first housing 11 and extending in the transverse direction and the longitudinal direction of the first connector 1. A mounting plate insertion portion 17*a* is a recessed portion formed on the upper surface of the fixing member installation portion 17 for receiving and mounting the inserted mounting plate portion 92 of the fixing member 91. The mounting plate portion 92 of the fixing member 91 is a member with a rectangular profile. The mounting plate insertion portion 17*a* is a rectangular recessed portion having an open upper surface and lower surface and a closed lower surface, front surface, and left and right surfaces to enable the mounting plate portion 92 to be inserted from the rear.

Insertion grooves 17*b* are formed on the left and right sides of the mounting plate insertion portion 17*a* for receiving the left and right sides of the mounting plate portion 92. The upper surface of the insertion grooves 17*a* is defined by overhang portions 17*d*. The front surface of the mounting plate insertion portion 17*a* is defined by a front wall portion 17*c* extending in the transverse direction of the first connector 1. The lower surface of the mounting plate insertion portion 17*a* is defined by a fixing member mounting base portion 14 fixed to the upper surface of the first housing 11. In this way, the mounting plate portion 92 can move forward from the rear of the fixing member installation portion 17 and be pushed into the mounting plate insertion portion 17*a*. At this time, the insertion space in the mounting plate portion 92 is defined on the upper surface by the overhang portions 17*d* and on the lower surface by the fixing member mounting base portion 14, thereby restricting the amount of vertical displacement.

An opening 14*a* is formed in the fixing member mounting base portion 14 which extends forward from near the rear end of the first connector 1. A flexible locking member 15 is arranged inside the opening 14*a*. This flexible locking member 15 is a cantilevered plate extending forward from the first connector 1 whose base end or rear end is integrally connected to the rear end of the fixing member mounting base portion 14. This functions as a cantilevered leaf spring in which the free end or front end 15*f* is displaceable in the vertical direction (the thickness direction of the first connector 1). Also, an engaging protruding portion 16, which protrudes upwards, is formed on the upper surface of the flexible locking member 15 near the front end 15*f*.

A locking recessed portion 93 is formed in the mounting plate portion 92 near the front end 92*f*. In the present embodiment, the locking recessed portion 93 is a through-hole passing through the mounting plate portion 92 in the thickness direction. The locking protruding portion 16 is inserted into and locked in the locking recessed portion 93 of the mounting plate portion 92 after it has been inserted into the mounting plate insertion portion 17*a*. More specifically, the locking protruding portion 16 has an inclined surface 16*a* formed near the rear of the first connector 1 and a perpendicular surface 16*b* formed near the front of the first connector 1. When the perpendicular surface 16*b* has engaged the locking surface 93*a* or wall surface of the engaging recessed portion 93 near the front end 92*f*, the locking protruding portion 16 engages the locking recessed portion 93.

A fitting recessed portion 12*b* is formed inside the covering portion 12. The fitting recessed portion 12*b* is a cavity opening into the front end 12*f* of the covering portion 12, which is also the front end of the first housing 11. When the first connector 1 and the second connector 101 are mated, this cavity receives the front portion of the second connector 101. A locking protruding portion 12*a* is formed in the bottom surface formed by the lower surface of the covering portion 12 near the front end 12*f* and protrudes upwards as described below.

The second connector 101 is integrally molded from an insulating material such as a synthetic resin, and consists of a second housing 111 mated with the first connector 1 and second terminals (not shown) made of metal which are mounted in the second housing 111.

The second housing 111 is a substantially parallelepiped box-like member extending in the arrangement direction of the electrical wires 198, that is, in the transverse direction of the second connector 101, and in the mating direction with the first connector 1, that is in the longitudinal direction of the second connector 101. The second housing 111 includes a covering portion 112 covering a portion of the second housing 111 near the rear end 111*r*, a locking member stopping portion 117 formed on the upper surface of the second housing 111, and a mating locking portion 115 formed on the lower surface of the second housing 111.

Also, the second housing 111 includes a plurality of terminal accommodating recessed portions 113 open on the front end 111*f* and the rear end 111*r* and extending in the longitudinal direction of the second connector 101. Each second terminal (not shown) connected and fixed to the front end of an electrical wire 198 is housed and held inside a terminal accommodating recessed portion 113. Each electrical wire 198 protrudes from an opening in a terminal accommodating recessed portion 113 to the rear of the second housing 111. In the example shown in the drawings, there are four second terminals and electrical wires 198 arranged side by side in a single row in the transverse direction of the second connector 101 at a predetermined pitch. However, the number of second terminals, the number of electrical wires 198, the pitch, and the number of rows can be changed if desired. A second retainer 121 is mounted on the rear end 111*r* of the second housing 111 to keep the second terminals and the electrical wires 198 from becoming detached from the terminal accommodating recessed portions 113.

The locking member stopping portion 117 protrudes upwards from the upper surface of the second housing 111 and extends in the longitudinal direction of the second connector 101 to the center of the second connector 101 in the transverse direction. When mating of the first connector 1 and the second connector 101 has been completed, the upper surface of the locking member stopping portion 117 approaches or makes contact with the lower surface of the flexible locking member 15 of the first connector 1 near the front end 15*f*. This prevents downward displacement of the front end 15*f* of the flexible locking member 15.

The mating locking portion 115 is a cantilevered member integrally connected at the base end to the lower surface of the second housing 111 near the front end 111*f* and extending towards the rear of the second connector 101. This functions as a cantilevered spring with the free end or rear end 115*r* being displaceable in the vertical direction (the thickness direction of the second connector 101). The covering portion 112 is a member covering the lower surface of the second housing 111 near the rear end 111*r*, and is positioned a certain distance below the lower surface of the second housing 111. The portion of the mating locking portion 115 near the rear end 115*r* is positioned between the covering portion 112 and the lower surface of the second housing 111, and approaches or makes contact with the upper surface of the covering portion 112 when external force is not being applied to the mating locking portion 115. This prevents downward displacement of the rear end 115*r* of the mating locking portion 115.

A locking recessed portion 116 is formed in the mating locking portion 115, and the wall surface of the locking recessed portion 116 near the front end 111*f* functions as a locking surface 116*a*. When mating of the first connector 1 and the second connector 101 is complete, the locking protruding portion 12*a* of the first connector 1 is inserted into the locking recessed portion 116 and engages the locking surface 116*a*. In this way, the first connector 1 and the second connector 101 are locked together.

The following is an explanation of the operations performed to install the fixing member 91 in the first connector 1 and mate the second connector 101.

Figure 4B:
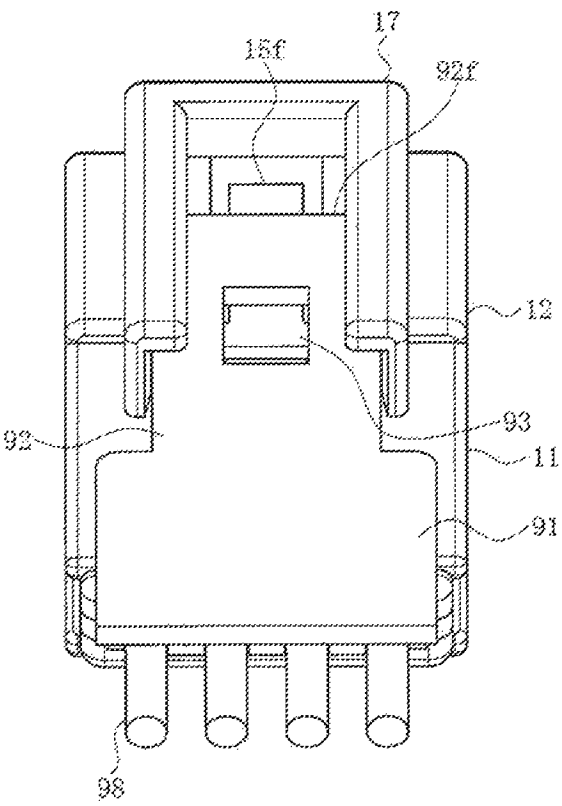
Figure 4A:
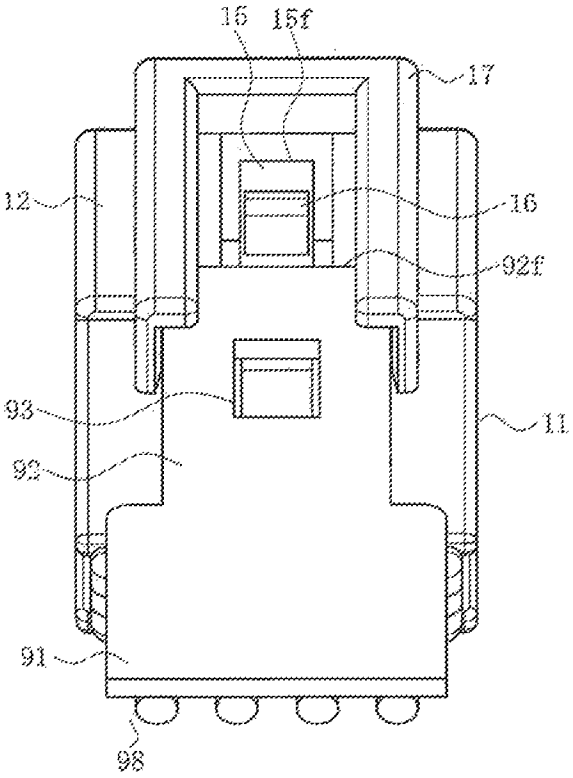
Figure 5:
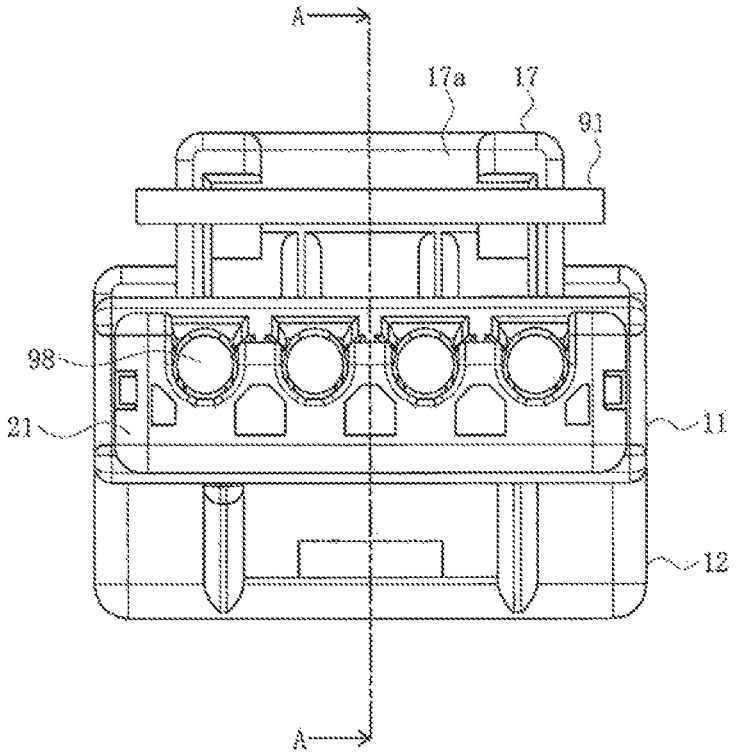
FIG. 5 is a rear view showing the fixing member being mounted on the first connector in the first embodiment.
Figure 6:
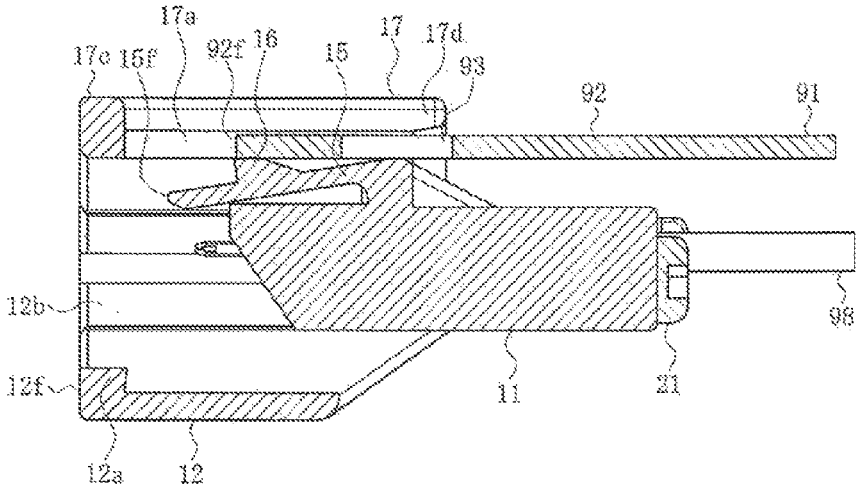
FIG. 6 is a cross-sectional view from arrows A-A in FIG. 5 showing the operations performed to install the fixing member on the first connector in the first embodiment.
Figure 7:
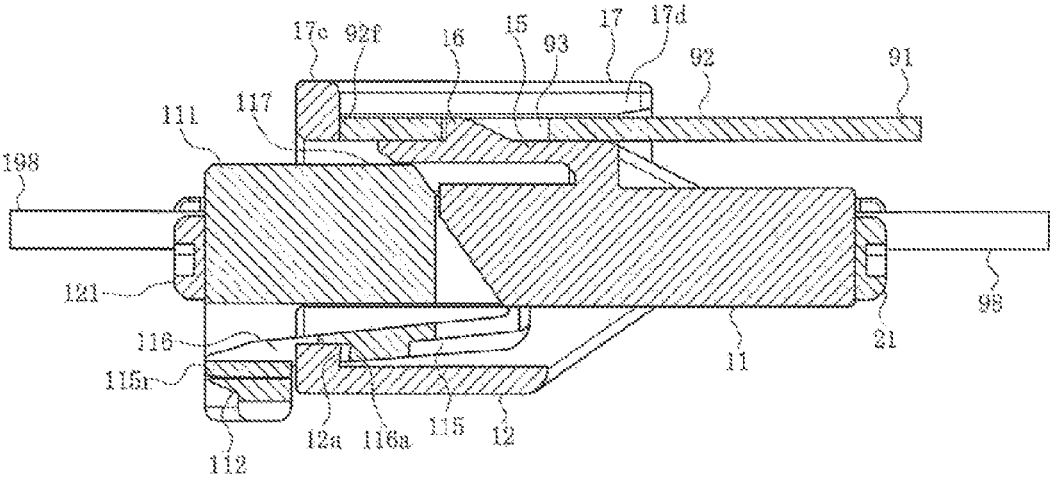
FIG. 7 is a cross-sectional view from arrows A-A in FIG. 5 showing the second connector mated with the first connector in the first embodiment.

FIGS. 4A and 4B are a pair of perspective views showing the operations performed to install the fixing member on the first connector in the first embodiment, FIG. 5 is a rear view showing the fixing member being mounted on the first connector in the first embodiment, FIG. 6 is a cross-sectional view from arrows A-A in FIG. 5 showing the operations performed to install the fixing member on the first connector in the first embodiment, and FIG. 7 is a cross-sectional view from arrows A-A in FIG. 5 showing the second connector mated with the first connector in the first embodiment. FIGS. 4A and 4B are views showing the fixing member being mounted on the first connector.

First, the operator manually manipulates the orientation of the fixing member 91 and the first connector 1 to position the front end 92*f* of the mounting plate portion 92 of the fixing member 91 so as to face the front wall portion 17*c* of the fixing member installation portion 17 of the first connector 1 and align the mounting plate portion 92 so as to be parallel to the upper surface of the insertion grooves 17*b*.

Next, the operator moves the fixing member 91 relative to the first housing 11 of the first connector 1, moves the mounting plate portion 92 forward from the rear of the fixing member installation portion 17, and into the mounting plate insertion portion 17*a* as shown in FIG. 4A. At this time, the mounting plate portion 92 is inserted into the insertion grooves 17*b* on both the left and right sides. As a result, upward displacement is restricted by the overhang portions 17*d*, downward displacement is restricted by the fixing member installation base portion 14, and the mounting plate portion 92 is inserted into the mounting plate insertion portion 17*a*.

Then, when the operator advances the mounting plate portion 92 further into the fixing member installation portion 17, as shown in FIG. 4B and FIG. 6, the portion of the mounting plate portion 92 near the front end 92*f* overcomes the locking protruding portion 16 formed on the upper surface of the flexible locking member 15. The mounting plate portion 92 is restricted by the overhang portions 17*d* and is not displaced upwards. Therefore, the flexible locking member 15 is pressed down by the mounting plate portion 92 and elastically displaced. As shown in FIG. 6, the portion near the front end 15*f* including the locking protruding portion 16 is elastically displaced into the first housing 11, that is, downwards.

Because the locking protruding portion 16 is displaced downwards in this way and because an inclined surface 16*a* is formed in the portion of the locking protruding portion 16 near the rear of the first connector 1, the mounting plate portion 92 does not meet great resistance and smoothly overcomes the locking protruding portion 16. Therefore, the force, that is, installation force, required to insert the mounting plate portion 92 in the mounting plate insertion portion 17*a* is small, and the locking protruding portion 16 made of an insulating material such as a synthetic resin is not shaved by the mounting plate portion 92 made of metal.

Then, when the operator moves the mounting plate portion 92 further forward relative to the fixing member installation portion 17, the front end 92*f* of the mounting plate portion 92 comes into contact with the front wall portion 17*c* of the fixing member installation portion 17 and the mounting plate portion 92 is stopped. Because the locking recessed portion 93 of the mounting plate portion 92 is positioned above the locking protruding portion 16, the spring action returns the flexible locking member 15 to its original shape, and the locking protruding portion 16 is displaced upwards and into the locking recessed portion 93 where it is locked. Because the perpendicular surface 16*b* of the locking protruding portion 16 is locked in the locking recessed portion 93, the mounting plate portion 92 cannot retreat and installation of the fixing member 91 in the first connector 1 is complete. When the flexible locking member 15 is returned to its original shape by the spring action, the operator feels the vibrations and hears a click. As a result, the operator can reliably detect when the fixing member 91 has been installed in the first connector 1.

Next, the operator manually manipulates the orientation of the first connector 1 and the second connector 101 so that the front end 12*f* of the covering portion 12 for the first housing 11 of the first connector 1 is facing the front end 111*f* of the second housing 111 of the second connector 101, and the upper surface of the first housing 11 is parallel with the upper surface of the second housing 111.

Then, the operator moves the second housing 111 of the second connector 101 towards the first housing 11 of the first connector 1, and inserts the second housing 111 into the fitting recessed portion 12*b* opening from the front end 111*f* into the front end 12*f* of the covering portion 12. When the operator moves the second housing 111 of the second connector 101 further forward, the lower surface of the mating locking portion 115 overcomes the upper surface of the locking protruding portion 12*a* formed in the bottom panel of the covering portion 12, and the mating locking portion 115 is displaced upwards.

Then, when the operator moves the second housing 111 of the second connector 101 further forward, the mating of the first connector 1 and the second connector 101 is completed, the first terminals in the first connector 1 come into contact with the second terminals in the second connector 101, and the electrical wires 98 connected to the first terminals establish an electrical connection with the electrical wires 198 connected to the second terminals. Because the locking recessed portion 116 of the mating locking portion 115 is positioned above the locking protruding portion 12*a*, the mating locking portion 115 is returned to its original shape by the spring action, the locking recessed portion 116 is displaced downward, and the locking protruding portion 12*a* enters the locking recessed portion 116 and engages the locking surface 116*a*. In this way, the first connector 1 and the second connector 101 are locked together, and the first connector 1 and the second connector 101 are prevented from becoming unmated.

Also, when mating of the first connector 1 and the second connector 101 has been completed, as shown in FIG. 7, the upper surface of the locking member stopping portion 117 of the second housing 111 approaches or makes contact with the lower surface of the flexible locking member 15 near the front end 15*f* in the first connector 1. Because downward displacement of the front end 15*f* of the flexible locking member 15 is inhibited, the mounting plate portion 92 can be reliably prevented from retreating and the fixing member 91 can be reliably prevented from becoming uninstalled.

In the explanation of the present embodiment, the locking protruding portion 12*a* is formed on the lower surface of the first housing 11 and the mating locking portion 115 including the locking recessed portion 116 is formed on the lower surface of the second housing 111. However, if necessary, the locking protruding portion 12*a* can be formed on a side surface of the first housing 11 and the mating locking portion 115 including the locking recessed portion 116 can be formed on a side surface of the second housing 111. In other words, the locking protruding portion 12*a* and the mating locking portion 115 including the locking recessed portion 116 may be formed on the side of the first housing 11 on which the fixing member installation portion 17 is formed and on the side of the second housing 111 opposite the side on which the locking member stopping portion 117 is formed.

The connector in the present embodiment comprises a first connector 1 including a first housing 11 which is capable of receiving an installed fixing member 91 and a second connector 101 including a second housing 111 which is mated with the first connector 1. The first housing 11 includes a fixing member installation portion 17 having a deformable flexible locking member 15 for locking the fixing member 91, and the second housing 111 includes a locking member stopping portion 117 for preventing deformation of the flexible locking member 15 when mating of the first connector 1 and the second connector 101 has been completed.

In this way, a connector can be obtained which requires the use of very little installation force for the fixing member 91, which reliably keeps the fixing member 91 from becoming detached when the first connector 1 and the second connector 101 are mated. In other words, a connector with a simple configuration can be obtained which has low manufacturing costs and which is highly durable.

Also, the fixing member 91 includes a locking recessed portion 93, and the flexible locking member 15 includes a locking protruding portion 16 that engages the locking recessed portion 93 when the fixing member 91 has been installed in the first connector 1. In this way, the fixing member 91 can be smoothly installed in the fixing member installation portion 17 using a small amount of installation force and the locking protruding portion 16 does not experience wear.

The fixing member installation portion 17 is arranged on one side surface of the first housing 11, the first housing 11 includes a locking protruding portion 12*a* arranged on the side surface not including the fixing member installation portion 17, the locking member stopping portion 117 is arranged on one side surface of the second housing 111, and the second housing 111 has a locking recessed portion 116 arranged on the side surface not including the locking member stopping portion 117, the locking recessed portion 116 engaging the locking protruding portion 12*a* when the first connector 1 and the second connector 101 have been mated. Because the locking protruding portion 12*a* and the locking recessed portion 116 engage each other, the first connector 1 and the second connector 101 are locked together and the first connector 1 and the second connector 101 do not become unmated. The operations performed by the flexible locking member 15 to engage the fixing member 91 are performed smoothly and do not interfere with the operations performed to engage the locking protruding portion 12*a* with the locking recessed portion 116.

When the fixing member 91 moves towards the first connector 1 in the direction of the first connector 1 mating with the second connector 101, it becomes mounted in the fixing member installation portion 17. Therefore, the operation performed to install the fixing member 91 in the first connector 1 is the same operation performed to mount the second connector 101 with the first connector 1. In other words, operability is improved.

The flexible locking member 15 is a cantilevered plate extending in the direction the first connector 1 is mated with the second connector 101 and displaceable into the first housing 11. When the first connector 1 and the second connector 101 have been mated, at least a portion of the second housing 111 is inserted into the first housing 11, and the locking member stopping portion 117 stops displacement of the flexible locking member 15 into the first housing 11. Therefore, the flexible locking member 15 can be smoothly deformed when the fixing member 91 is installed in the first connector 1. Also, the flexible locking member 15 does not catch on surrounding components even when the first connector 1 and the second connector 101 are mated in a cramped place without much surrounding space.

The fixing member 91 includes a mounting plate portion 92 formed on the leading end and a base end fixed to a structural member. The flat mounting plate portion 92 is installed in the fixing member installation portion 17. In this way, the first connector 1 can be fixed to a structural member using a fixing member 91 with a simple configuration.

The following is an explanation of a second embodiment. All elements identical to those in the first embodiment are denoted by the same reference numbers and further explanation of these elements has been omitted. Explanation of all operations and effects that are the same as those in the first embodiment has also been omitted.

Figure 8:
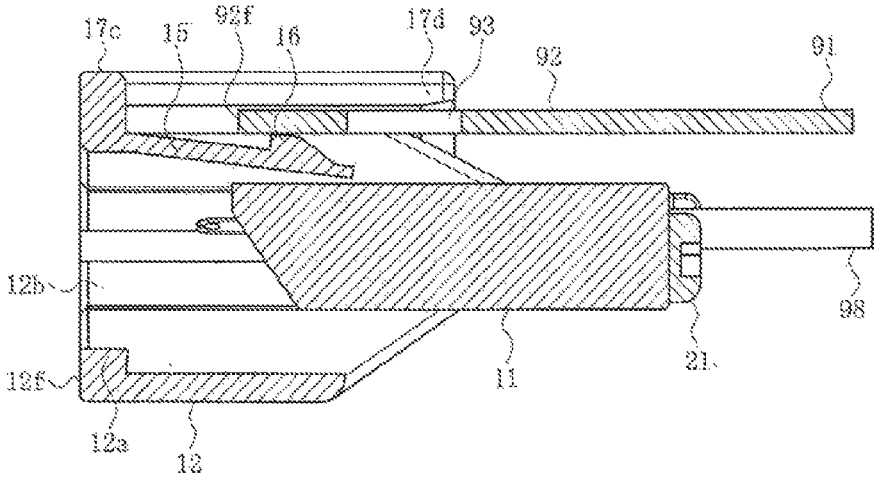
FIG. 8 is a cross-sectional view from arrows A-A in FIG. 5 showing the operations performed to install the fixing member on the first connector in the second embodiment.
Figure 9:
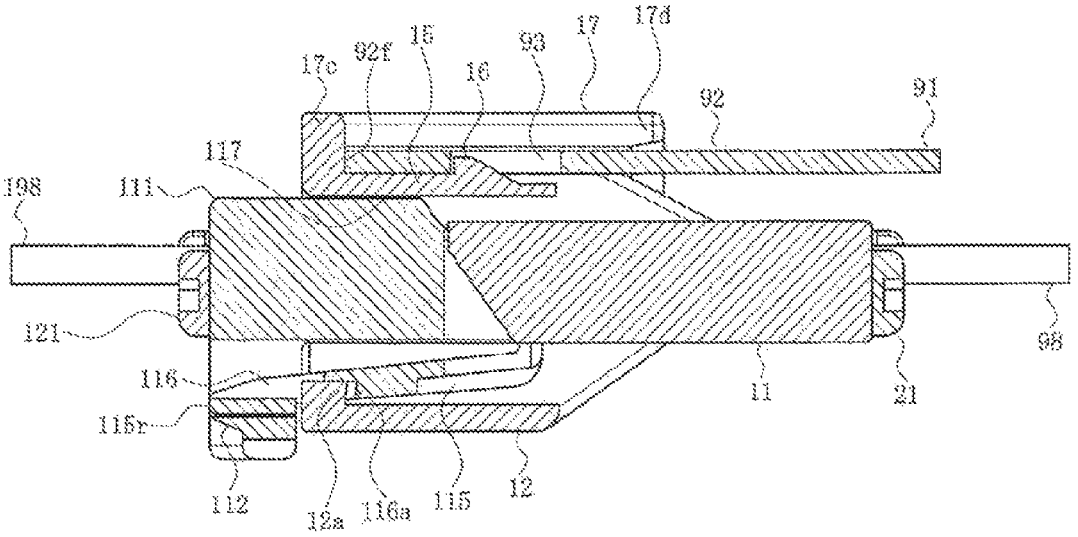
FIG. 9 is a cross-sectional view from arrows A-A in FIG. 5 showing the second connector mated with the first connector in the second embodiment.

FIG. 8 is a cross-sectional view from arrows A-A in FIG. 5 showing the operations performed to install the fixing member on the first connector in the second embodiment, and FIG. 9 is a cross-sectional view from arrows A-A in FIG. 5 showing the second connector mated with the first connector in the second embodiment.

In the first embodiment, the flexible locking member 15 is a cantilevered plate extending forward from the first connector 1 whose rear end or base end is integrally connected to the rear end of the fixing member mounting base portion 14. In the present embodiment, the flexible locking member 15 is a cantilevered plate extending rearward from the first connector 1 whose front end or base end is integrally connected to the front wall portion 17*c* of the fixing member installation portion 17. Note that the upward protruding locking protruding portion 16 formed on the upper surface of the flexible locking member 15 near the free end is the same as in the flexible locking member 15 in the first embodiment.

Because all the other aspects of the first connector 1, the second connector 101, and the fixing member 91 in the present invention are identical to those in the first embodiment, further explanation of these aspects has been omitted. Also, because the operations performed to install the fixing member 91 in the first connector 1 and mate the second connector 101 in the present embodiment are the same as those in the first embodiment, further explanation of these operations has been omitted.

In the present embodiment, when the first connector 1 and the second connector 101 have been mated, as shown in FIG. 9, the upper surface of the locking member stopping portion 117 of the second housing 111 approaches or comes into contact with the lower surface of the flexible locking member 15 of the first connector 1 not near the free end but near the base end. Because downward displacement of the flexible locking member 15 is inhibited, the mounting plate portion 92 can be reliably prevented from retreating and the fixing member 91 can be reliably prevented from becoming uninstalled.

Because the free end of the flexible locking member 15 and the locking protruding portion 16 can be displaced downward to a certain extent even when the first connector 1 and the second connector 101 have been mated, the fixing member 91 can be installed in the first connector 1 after the first connector 1 and the second connector 101 have been mated.

The following is an explanation of a third embodiment. All elements identical to those in the first embodiment and the second embodiment are denoted by the same reference numbers and further explanation of these elements has been omitted. Explanation of all operations and effects that are the same as those in the first embodiment and the second embodiment has also been omitted.

Figure 10B:
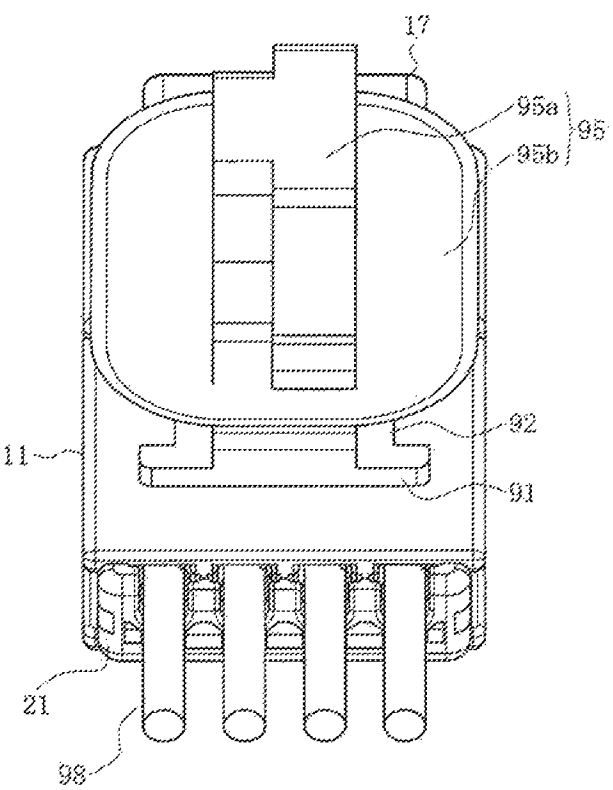
FIGS. 10A and 10B are perspective views showing the operations performed to install the fixing member in the first connector in a third embodiment.
Figure 10A:
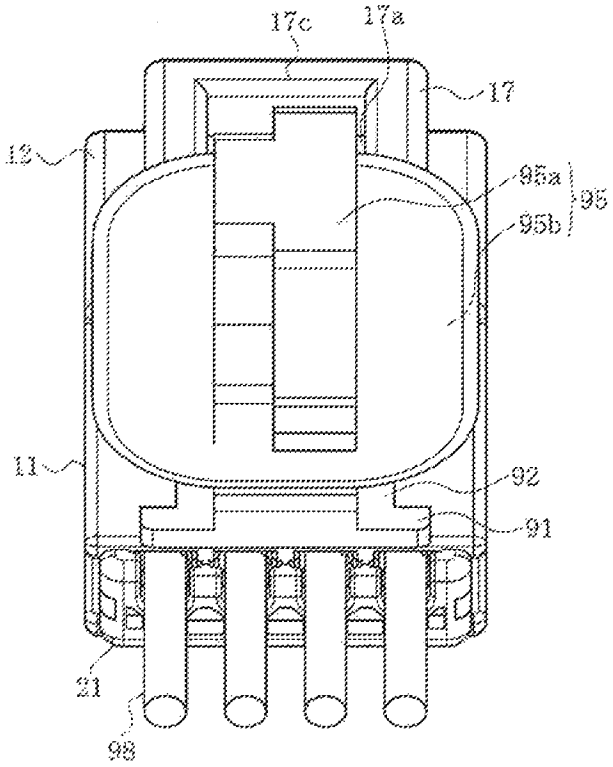
Figure 11:
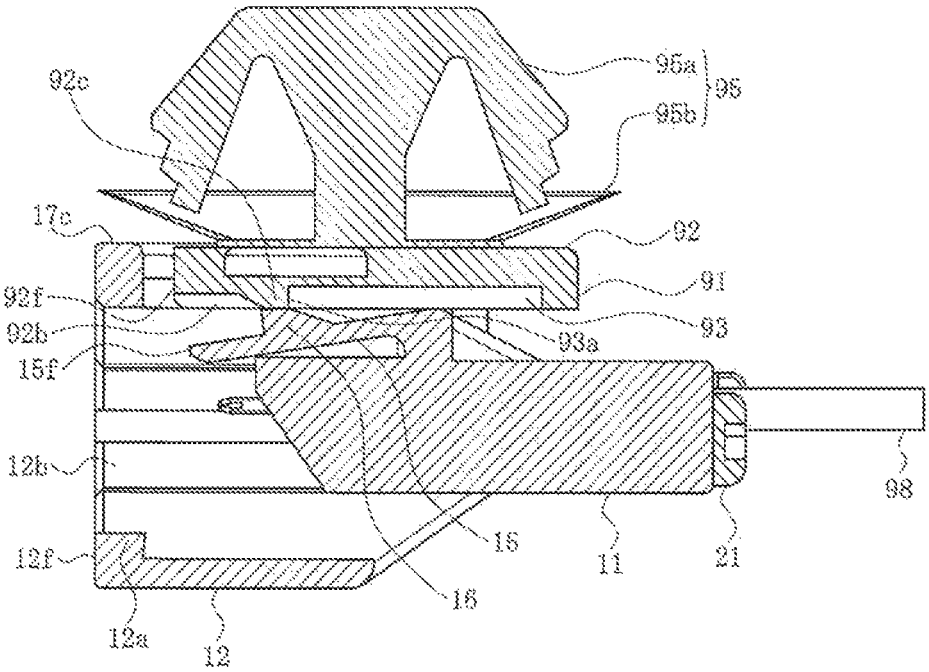
FIG. 11 is a cross-sectional view from arrows A-A in FIG. 5 showing the operations performed to install the fixing member on the first connector in the third embodiment.
Figure 12:
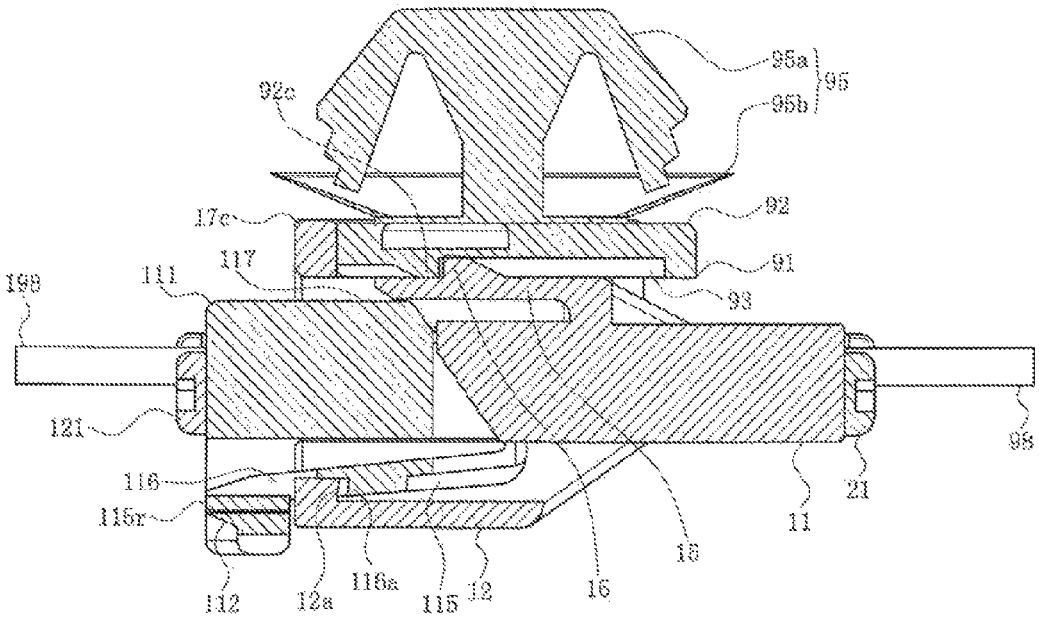
FIG. 12 is a cross-sectional view from arrows A-A in FIG. 5 showing the second connector mated with the first connector in the third embodiment.
Figure 13:
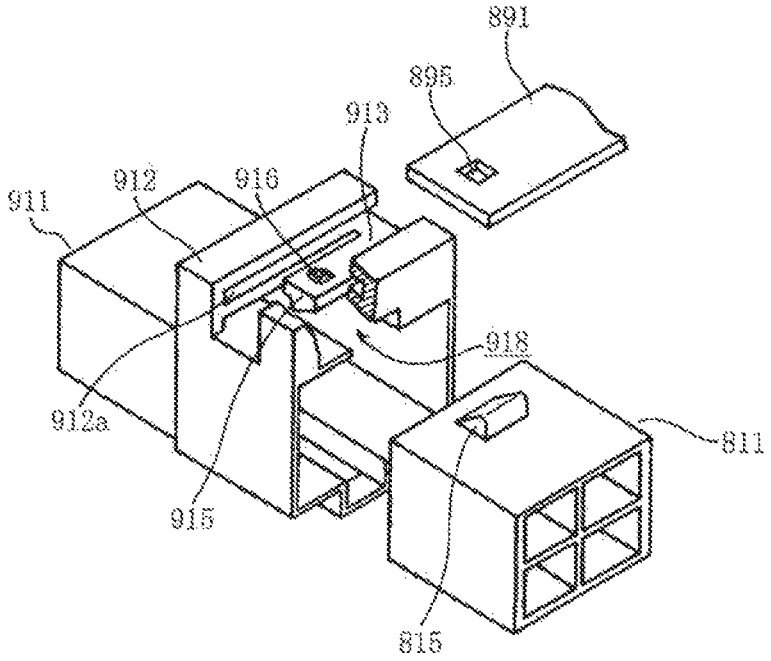
FIG. 13 Prior Art
FIG. 13 is a perspective view of a connector of the prior art.

FIGS. 10A and 10B are perspective views showing the operations performed to install the fixing member in the first connector in a third embodiment, FIG. 11 is a cross-sectional view from arrows A-A in FIG. 5 showing the operations performed to install the fixing member on the first connector in the third embodiment, and FIG. 12 is a cross-sectional view from arrows A-A in FIG. 5 showing the second connector mated with the first connector in the third embodiment.

In the first and second embodiments, the fixing member 91 was fixed at the base end to a slender structural element commonly called a stay. In the present embodiment, the fixing member 91 has a clip portion 95 or fixed portion connected to the upper surface of the mounting plate portion 92, and the clip portion 95 is fixed to the structural member. The clip portion 95 includes a retainer portion 95*a* made of a resilient material such as a metal band and a flange portion 95*b*. When the retainer portion 95*a* is pressed into a through-hole formed in a plate-shaped structural member such as the body of a vehicle from one side, the plate-like structural member becomes interposed between the flange portion 95*b* and the retainer portion 95*a* which has returned to its original shape. In this way, the fixing member can be fixed to a plate-shaped structural member.

The locking recessed portion 93 formed in the mounting plate portion 92 near the front end 92*f* was a through-hole passing through the mounting plate portion 92 in the thickness direction in the first and second embodiments, and an indented portion extending upward from the lower surface of the mounting plate portion 92 in the present embodiment. The depth of the indentation is preferably greater than the height of the locking protruding portion 16 protruding upwards from the upper surface of the flexible locking member 15.

Also, a leading end indented portion 92*b* which extends upwards from the lower surface of the mounting plate portion 92 is preferably formed a predetermined distance from the front end 92*f* on the lower surface of the mounting plate portion 92. In this way, a protruding portion 92*c* which protrudes downward in a relative manner is formed between the leading end indented portion 92*b* on the lower surface of the mounting plate portion 92 and the locking recessed portion 93, and the surface to the rear of the protruding portion 92*c* forms a locking surface 93*a* in the locking recessed portion 93.

Because all the other aspects of the first connector 1, the second connector 101, and the fixing member 91 in the present invention are identical to those in the first embodiment, further explanation of these aspects has been omitted.

In the present embodiment, when the fixing member 91 is to be installed in the first connector 1, the operator manually manipulates the orientation of the fixing member 91 and the first connector 1 so that the front end 92*f* of the mounting plate portion 92 of the fixing member 91 is facing the front wall portion 17*c* of the fixing member installation portion 17 of the first connector 1, and the mounting plate portion 92 is parallel to the upper surface of the insertion grooves 17*b*.

Next, the operator moves the fixing member 91 towards the first housing 11 of the first connector 1. The mounting plate portion 92 moves forward from the rear of the fixing member installation portion 17 and, as shown in FIG. 10A, is inserted into the mounting plate insertion portion 17*a*. At this time, the left and right sides of the mounting plate portion 92 are inserted into the insertion grooves 17*b*. As a result, upward displacement is restricted by the overhang portions 17*d* and downward displacement is restricted by the fixing member mounting base portion 14 as the mounting plate portion 92 is inserted into the mounting plate insertion portion 17*a*.

When the operator moves the mounting plate portion 92 further forward in the fixing member installation portion 17, as shown in FIG. 10B and FIG. 11, the protruding portion 92*c* in the mounting plate portion 92 near the front end 92*f* overcomes the locking protruding portion 16 formed on the upper surface of the flexible locking member 15. Because the mounting plate portion 92 is restrained by the overhang portions 17*d* at this time, it cannot be displaced upwards. As a result, the flexible locking member 15 is pushed down by the mounting plate portion 92 and elastically deformed. As shown in FIG. 11, the portion near the front end 15*f* including the locking protruding portion 16 is also displaced downwards.

Then, when the operator moves the mounting plate portion 92 further into the fixing member installation portion 17, as shown in FIG. 12, the front end 92*f* of the mounting plate portion 92 comes into contact with the front wall portion 17*c* of the fixing member installation portion 17 and the mounting plate portion 92 is stopped. Because the locking recessed portion 93 of the mounting plate portion 92 is positioned above the locking protruding portion 16, the flexible locking member 15 is returned to its original shape by the spring action, the locking protruding portion 16 is displaced upwards and enters the locking recessed portion 93 where it becomes locked. Because the perpendicular surface 16*b* of the locking protruding portion 16 faces the locking surface 93*a* of the locking recessed portion 93 and the locking protruding portion 16 is locked in the locking recessed portion 93, the mounting plate portion 92 cannot retreat, and the fixing member 91 is installed in the connector 1.

Next, the operator manually moves the second housing 111 of the second connector 101 towards the first housing 11 of the first connector 1 and mates the second connector 101 with the first connector 1. Because the operations performed to mate the second connector 101 with the first connector 1 are the same as those performed in the first embodiment, further explanation has been omitted.

When the first connector 1 and the second connector 101 have been mated, as shown in FIG. 12, the upper surface of the locking member stopping portion 117 in the second housing 111 approaches or comes into contact with the front end 15*f* of the flexible locking member 15 of the first connector 1. Because this keeps the front end 15*f* of the flexible locking member 15 from being displaced downward, the mounting plate portion 92 is reliably prevented from retreating and the fixing member 91 is reliably prevented from becoming uninstalled.

The clip portion 95 may be fixed to a structural member before the fixing member 91 has been installed in the first connector 1, may be fixed to the structural member after the fixing member 91 has been installed in the first connector 1, or may be fixed to the structural member after the second connector 101 has been mated with the first connector 1.

In the present embodiment, as mentioned above, the fixing member 91 has a flat mounting plate portion 92 installed in a fixing member installation portion 17 and a clip portion 95 connected to one surface of the mounting plate portion 92 and fixed to a structural member. As a result, the first connector 1 is easily fixed to the structural member.

In the disclosure of the present specification, characteristics related to specific preferred embodiments were described. A person of ordinary skill in the art could naturally devise other embodiments, modifications, and variations with reference to the disclosure of the present specification without departing from the spirit and scope of the appended claims.

The present disclosure can be applied to a connector.

The invention claimed is:

1. A connector assembly comprising:

a first connector including a first housing which is configured to receive an installed fixing member; and a second connector including a second housing which is mated with the first connector, wherein the first housing includes a fixing member installation portion having a deformable flexible locking member for locking the fixing member, and wherein the second housing includes a stopping member for preventing deformation of the flexible locking member when mating of the first connector and the second connector has been completed.

2. The connector assembly according to claim 1, wherein the fixing member includes a locking recessed portion, and the flexible locking member includes a locking protruding portion for locking the locking recessed portion when installation of the fixing member on the first connector has been completed.

3. The connector assembly according to claim 1, wherein the fixing member installation portion is arranged on a side surface of the first housing, the first housing also includes a locking protruding portion arranged on a side surface other than the one on which the fixing member installation portion has been arranged, the stopping member is arranged on a side surface of the second housing, and the second housing also includes a locking recessed portion arranged on a side surface other than the one on which the stopping member has been arranged, the locking recessed portion engaging the locking protruding portion when mating of the first connector and the second connector has been completed.

4. The connector assembly according to claim 1, wherein the fixing member is installed in the fixing member installation portion by moving the fixing member relative to the first connector in the mating direction of the first connector with the second connector.

5. The connector assembly according to claim 1, wherein the flexible locking member is a cantilevered plate extending in the mating direction of the first connector with the second connector or in the opposite direction thereof and displaceable towards the inside of the first housing, and at least a portion of the second housing enters the first housing and the stopping member is prevented from being displaced towards the inside of the first housing by the flexible engaging member when mating of the first connector and the second connector has been completed.

6. The connector assembly according to claim 1, wherein the fixing member has a mounting plate portion formed on the leading end, the flat mounting plate portion being installed on the fixing member installation portion, and a base end fixed to a structural member.

7. The connector assembly according to claim 1, wherein the fixing member has a flat mounting plate portion installed on the fixing member installation portion, and a fixed portion connected to a surface of the mounting plate portion and fixed to a structural member.

* * * * *